US006324951B1

(12) United States Patent
Wegener

(10) Patent No.: US 6,324,951 B1
(45) Date of Patent: Dec. 4, 2001

(54) SYSTEM FOR PUNCHING AND BUNDLING METAL SHEETS

(75) Inventor: Konrad Wegener, Goeppingen (DE)

(73) Assignee: Schuler Pressen GmbH & Co., KG, Goeppingen (DE)

( * ) Notice: Subject to any disclaimer, the term of this patent is extended or adjusted under 35 U.S.C. 154(b) by 0 days.

(21) Appl. No.: 09/419,112

(22) Filed: Oct. 15, 1999

(30) Foreign Application Priority Data

Oct. 15, 1998 (DE) ..... 198 47 552

(51) Int. Cl.[7] ..... B30B 15/32; B26D 7/27; B26F 1/00

(52) U.S. Cl. ..... 83/89; 83/91; 83/102; 83/149; 83/167; 83/452; 83/685

(58) Field of Search ..... 83/55, 81, 89–92, 83/92.1, 94, 102, 162, 167, 452, 454, 465, 684, 685, 147, 149, 163, 166

(56) References Cited

U.S. PATENT DOCUMENTS 3,466,833 * 9/1969 Penrod et al. ..... 83/95 X
3,546,990 * 12/1970 Schneider ..... 83/27
4,108,031 * 8/1978 Dangelmaier et al. ..... 83/90
4,110,895 * 9/1978 Mitsui ..... 29/564.2
4,232,575 * 11/1980 Schneider et al. ..... 83/71
4,716,800 * 1/1988 Bareis et al. ..... 83/91
4,982,635 * 1/1991 Thatcher ..... 83/149
5,183,247 * 2/1993 Blumer ..... 270/95
5,249,492 * 10/1993 Brown et al. ..... 83/23
5,768,963 * 6/1998 Bruehwiler ..... 83/27

* cited by examiner

*Primary Examiner*—Boyer Ashley
(74) *Attorney, Agent, or Firm*—Crowell & Moring LLP

(57) ABSTRACT

A system for punching and bundling metal sheets, particularly for electric machines, has a die for punching the metal sheets. A die plate cooperates with the die, and a shaft receives and stacks the punched metal sheets. A device separates the punched metal sheets stacked in the receiving shaft. The separating device has at least two wedge elements which penetrate at a predetermined height of the stack of punched metal sheets, into the metal sheet stack at least approximately perpendicularly to the longitudinal axis of the receiving shaft.

2 Claims, 3 Drawing Sheets

SYSTEM FOR PUNCHING AND BUNDLING METAL SHEETS

BACKGROUND OF THE INVENTION

This application claims the priority of 198 47 552.7, filed Oct. 15, 1998, the disclosure of which is expressly incorporated by reference herein.

The present invention relates to a system for punching and bundling metal sheets having a die for punching the metal sheets, a die plate cooperating with the die, a receiving shaft for receiving and stacking the punched metal sheets, a separating device for separating the metal sheets stacked in the receiving shaft. Furthermore, the present invention relates to a process for punching and bundling metal sheets in which metal sheets are punched by means of a die and a die plate cooperating with the die, onto a metal sheet stack.

A known type of punching and bundling system is described in DE 31 47 034 A1. A certain number of metal sheets situated in the receiving shaft are displaced to the side as metal sheets bundles by way of a cross slide, while the metal sheets situated above this metal sheet bundle are held in the receiving shaft. The metal sheets which were pushed to the side can then in each case be transported and processed as metal sheet bundles. The entire operation takes place during the punching of the metal sheets.

It is a disadvantage of this system and of the associated process that all components must have very precise tolerances and their manufacturing is therefore very expensive. The process itself is very complicated, and extremely cumbersome resetting operations are required for producing metal sheet bundles of different heights. In addition, metal sheet bundles of continuously precise heights cannot be produced with this system.

DE 28 39 928 A1 describes a system for conveying, stacking and bundling, corresponding to the correct punching pattern, of metal sheets of electric machines. A welding device is mounted below the die plate for continuously successively welding together the metal sheets and discharging them from the press as a strip. With this system, metal sheet bundles of a predetermined length can also be produced. The precision required for this purpose cannot, however, be achieved with the construction of the disclosed welding device.

A similar system is described in EP 0 343 661 A1. There, the metal sheet bundles are welded directly in the die plate in that a welding spot is set at each stroke of the die. The welding device cannot operate continuously, however, whereby the welds only have a very limited durability. Another disadvantage of this known welding device is that a portion of the laser lens system of the welding device is mounted inside the tool and must remain on it, or must be newly mounted and aligned during each tool change at high expenditures.

DE 26 05 983 C3 and DE 26 30 867 C2 describe additional systems for stacking and bundling punched parts, in which case, by way of a mandrel, a slide, a cylinder/piston unit as well as a pawl, intermediate stacks are formed of the punched plates. These systems have a disadvantage in that, during the resetting to other metal sheets, the mandrels must be exchanged in a cumbersome manner.

With respect to additional prior art concerning systems for punching and bundling metal sheets, reference is also made to DE 20 65 645 A1; DE 23 39 322 A1; DE 26 19 127 A1; and DE 27 06 274 A1.

SUMMARY OF THE INVENTION

An object of the present invention is to provide a system and process for punching and bundling metal sheets, whereby individual metal sheet bundles of the punched metal sheets can be separated such that the metal sheet bundles have a very exact height. The production of metal sheet bundles of different heights and of different numbers of individual sheets is thus made possible in a very simple manner.

According to the invention, this object has been achieved by providing that the separating device has at least two wedge elements which are provided for penetrating, in the case of a predetermined height of the metal sheet stack of punched metal sheets, into this metal sheet stack at least approximately perpendicularly to the longitudinal axis of the receiving shaft.

With respect to the process according to the present invention, the object has been achieved by providing that metal sheet bundles of a predetermined height are separated from the metal sheet stack, after which the individual metal sheets of the metal sheet bundles are connected with one another by being guided past a connection device.

The separating device according to the invention having the at least two wedge elements allows the separation of a metal sheet bundle of a desired height consisting of the individual metal sheets situated in the receiving shaft to be achieved in a very simple and exact manner. That is, the wedge elements engage according to the invention in a standing bundle and not, as provided in the case of the known separating devices, in the metal sheets falling from the die plate into the receiving shaft.

As the result of the use of wedge elements, a precise height of the separated metal sheet bundle of plus/minus one punched sheet is obtained. This precision can be increased by a more or less extensive penetration of the wedge elements into the metal sheet bundle. According to how far the wedge elements penetrate in the radial direction into the bundle, the metal sheets are compressed to a greater or smaller extent and the height of the metal sheet stack can therefore be influenced, although the number of individual sheets can actually no longer be changed after the engagement of the wedge elements.

In a particularly advantageous further development of the present invention, device for connecting the separated individual metal sheet bundles is provided in the area of the receiving shaft or under the receiving shaft. As a result, the metal sheet bundles separated by the separating device can be connected with one another, whereby metal sheet bundles or metal sheet stacks are advantageously created which have a precisely defined height.

The process according to the invention allows the separation and the subsequent connection of the metal sheet bundles to take place without interruption of the punching.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
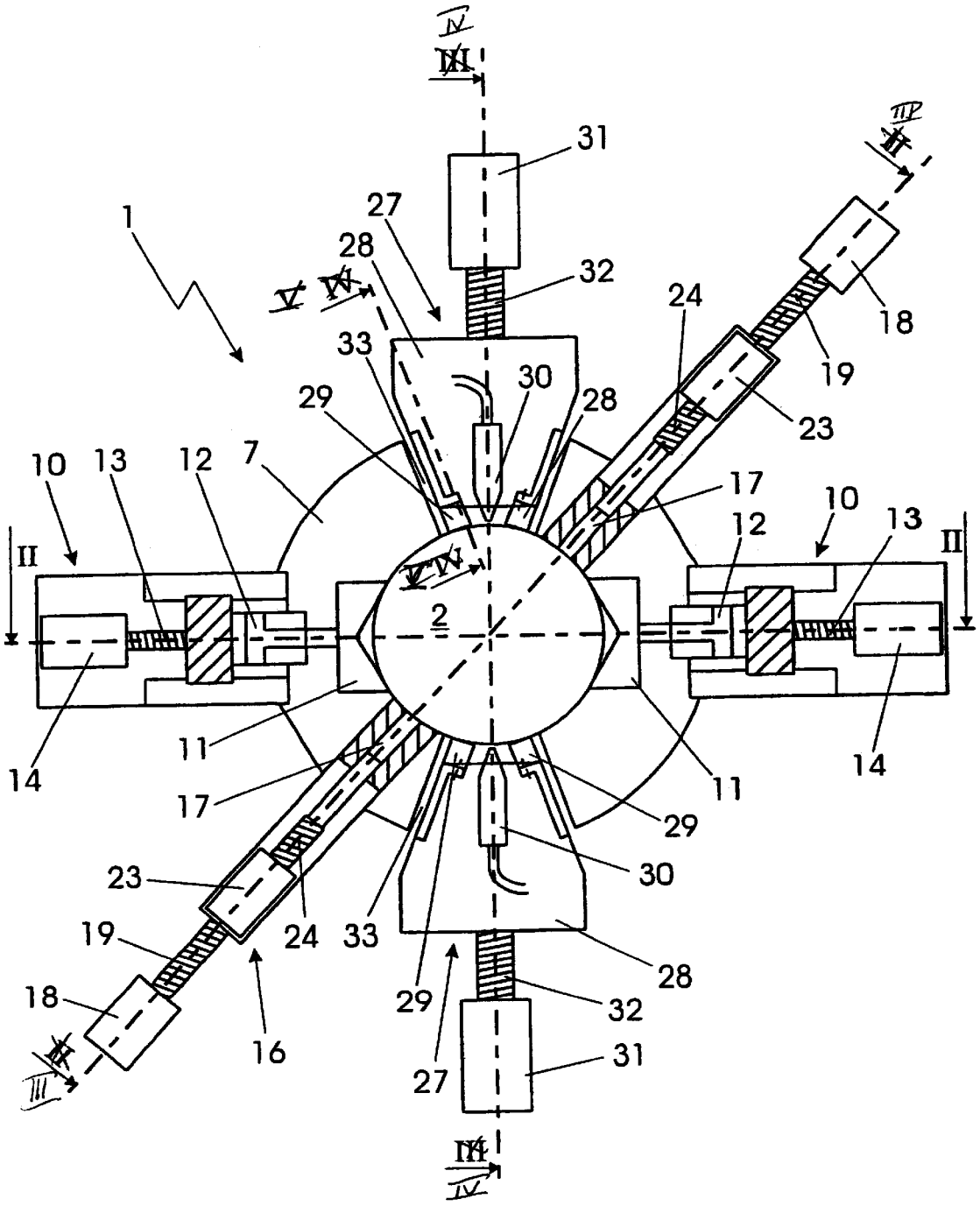
FIG. 1 is a top view of the system according to the invention without a punching tool.
Figure 2:
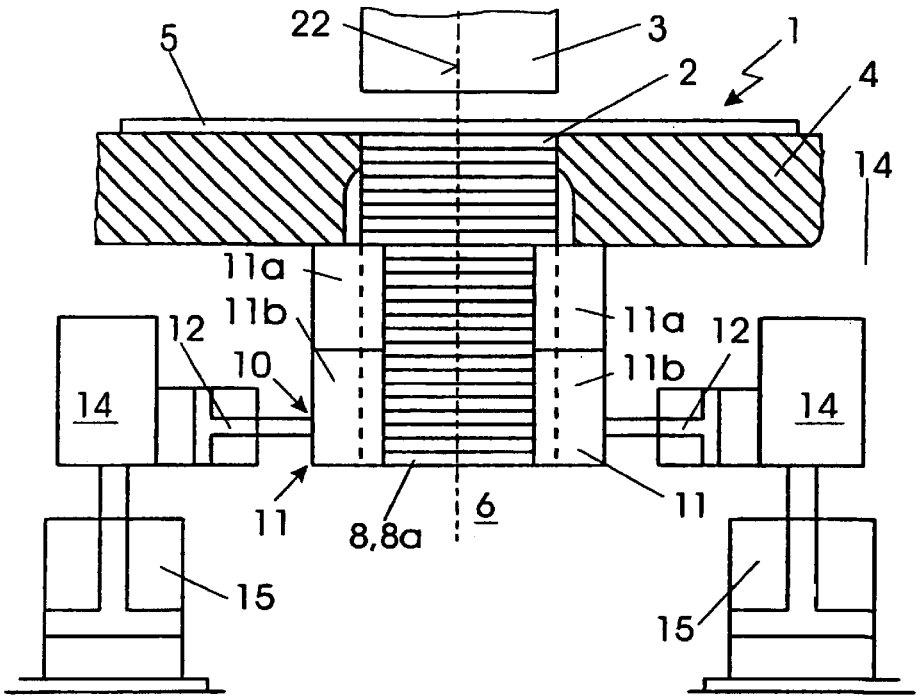
FIG. 2 is a sectional view along line II—II of FIG. 1 with an outlined die.
Figure 3:
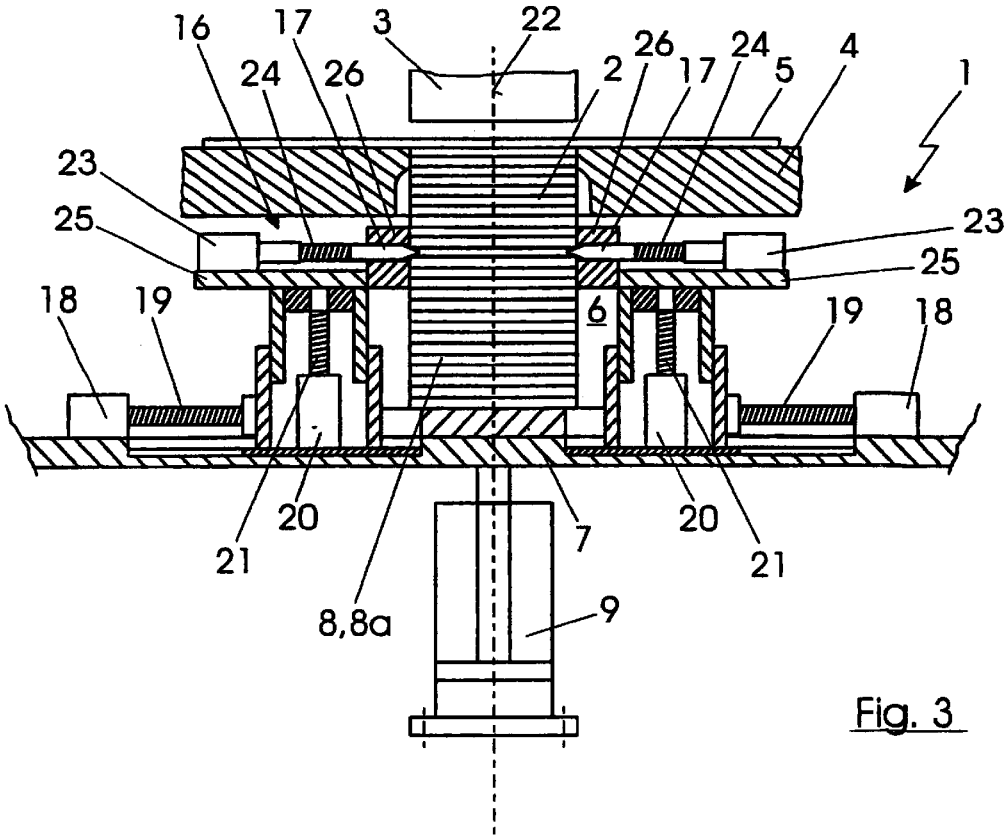
FIG. 3 is a sectional view along line III—III of FIG. 1 with an outlined die.

FIGS. 1, 2 and 3 show a system for punching and bundling preferably round metal punching sheets 2 which are produced in a generally known manner from a sheet metal strip 5 by a tool top part or die 3 and a tool bottom part or die plate 4 interacting with the die 3. Of course, punched sheets 2 of a different geometry can also be produced.

Below the die plate 4, a receiving shaft 6 receives the punched sheets 2 which are dropped and stacked on a supporting element 7, and form a metal sheet bundle 8 situated at the lower end of the receiving shaft 6. On its bottom side, the supporting element 7 has a stroke device 9 for moving the supporting element 7 downward during the punching of the metal sheets 2. Thus, it is ensured that new metal sheets 2 are punched continuously and can arrive in the receiving shaft 6. The stroke device 9 is also capable of again displacing, as required, the supporting element 7 upward in the direction of the die plate 4. The stroke device 9 can have an electric, pneumatic or hydraulic construction and can be connected with a control of the die 3 (not shown), and thus can be moved downward at each stroke of the die 3 by the thickness of one metal sheet 2.

Inside the receiving shaft 6, a clamping device 10 is situated to hold the metal sheets 2. On its area facing the metal sheets 2, the clamping device 10 has two mutually opposite prism-shaped holding elements 11. The holding elements 11 are each connected with spindles 13 by way of connection elements 12, and the spindles 13 are driven by driving devices 14 situated on the clamping device 10. Thus, the prism-shaped holding elements 11 can be displaced in the direction of the metal sheets 2. Of course, it is also contemplated that the two driving devices 14 can be coupled with one another with respect to the control.

The clamping device 10 assures that the metal sheets 2 do not drop downward when the supporting element 7 is moved. For this reason, the holding elements 11 are constructed in two parts, i.e. one top part 11*a* and one bottom part 11*b*, respectively. Only the bottom parts 11*b* are used for clamping the metal sheets 2, whereas the top parts 11*a* are used for guiding the punched metal sheets leaving the die plate 4. When the bottom parts 11*b* engage in the direction of the metal sheets 2, which is caused by the driving devices 14, the top parts 11*a* therefore remain at the same point.

When the supporting element 7 with the metal sheet stack 8 moves downward, the bottom parts 11*b* of the holding elements 11, together with the lowest metal sheet 2 clamped into them, form a stack routing device which separates the punched metal sheets in the metal sheet stack 8, which are to be discharged, from the punched metal sheets 2 which must still be stacked. Thereby, the clamping device 10 also prevents rotation of the punched metal sheets 2. In order to permit a continuation of the punching of the metal sheets 2, the bottom parts 11*b* move downward simultaneously with the punching operation, advancing by the metal sheet thickness times the stroke. For this purpose, the clamping device 10 is provided with two driving or stroke devices 15 which are capable of vertically adjusting or moving the clamping device 10 together with its driving devices.

When the clamping device 10 is disengaged and the punched sheets 2 are stacked directly on the supporting element 7, this downward movement is taken over by the supporting element 7. It will also be understood that the clamping device 10 can be adjusted to different diameters of punched metal sheets 2.

In order to divide the metal sheet stack 8 into individual metal sheet bundles 8*a* of a defined height, as illustrated in FIG. 3, or to separate a metal sheet bundle 8*a* from the metal sheet stack 8, a separating device designated generally by numeral 16 is provided on the supporting element 7. The separating device 16 has, on its side facing the punched metal sheets 2, two mutually opposite wedge elements 17. Each wedge element 17 has one driving device 18 respectively which has a spindle 19 for adjusting the separating device 16 to different diameters of the punched sheets 2. A driving device 20 with a spindle 21 adjusts the height of the wedge elements 17 in the direction of a longitudinal axis 22 of the receiving shaft 6. A respective driving device 23 has a spindle 24 for engaging the wedge elements 17 in the metal sheet stack 8. The longitudinal axis 22 therefore extends in the punching direction and also forms the longitudinal axis 22 of the die 3.

The driving devices 18 are situated on the supporting element 7 and, by way of the spindles 19, displace the driving devices 10, 23 perpendicularly to the longitudinal axis 22. The driving devices 20 are also arranged on the supporting element 7, with the spindles 21 are arranged in the vertical direction and parallel to the longitudinal axis 22. As a result, the wedge elements 17 can be adjusted height-wise which, when they are engaged, results in metal sheet bundles 8*a* of different heights. The driving devices 23, whose spindles 24 extend parallel to the spindles 19, are each mounted on a plate 25 which, as described above, can be height-wise adjusted by the driving devices 20. All driving devices 14, 18, 20 and 23 can have an electric, pneumatic or hydraulic construction, and the associated spindles 13, 19, 21 and 24 can each be controlled by, for example, a known NC control, of the system 1. Instead of equipping the driving devices 14, 18, 20 and 23 with the spindles 13, 19, 21 and 24, linear drives can also be provided as driving devices 14, 18, 20 and 23.

In order to separate a metal sheet bundle 8*a* of a defined height from the metal sheet stack 8, first one of the wedge elements 17, which are both disposed between guiding elements 26, is moved perpendicularly to the longitudinal axis 22 into the plate stack 8. The clamping device 10 also simultaneously clamps the punched metal sheets 2 situated above the wedge element 17 by a corresponding engagement of the holding elements 11. As a result, additional punched sheets 2 are prevented from dropping downward onto the already separated metal sheet bundle 8*a*. The supporting element 7, with the separating device 16 situated thereon, then moves downward, and also the second wedge element 17 engages above the metal sheet bundle 8*a*. Thus, the uppermost punched metal sheet 2 in the separated metal sheet bundle 8*a* is always aligned horizontally. According to how far the wedge elements 17 are moved in, the height of the metal sheet bundle 8*a* can be influenced by the corresponding application of force, and this height can therefore be adjusted very precisely. This moving-in of the wedge elements 17 is controlled by the driving devices 23. For this purpose, a desired value is defined for the latter, up to which value these will then correspondingly move into the metal sheet stack 8.

Figure 4:
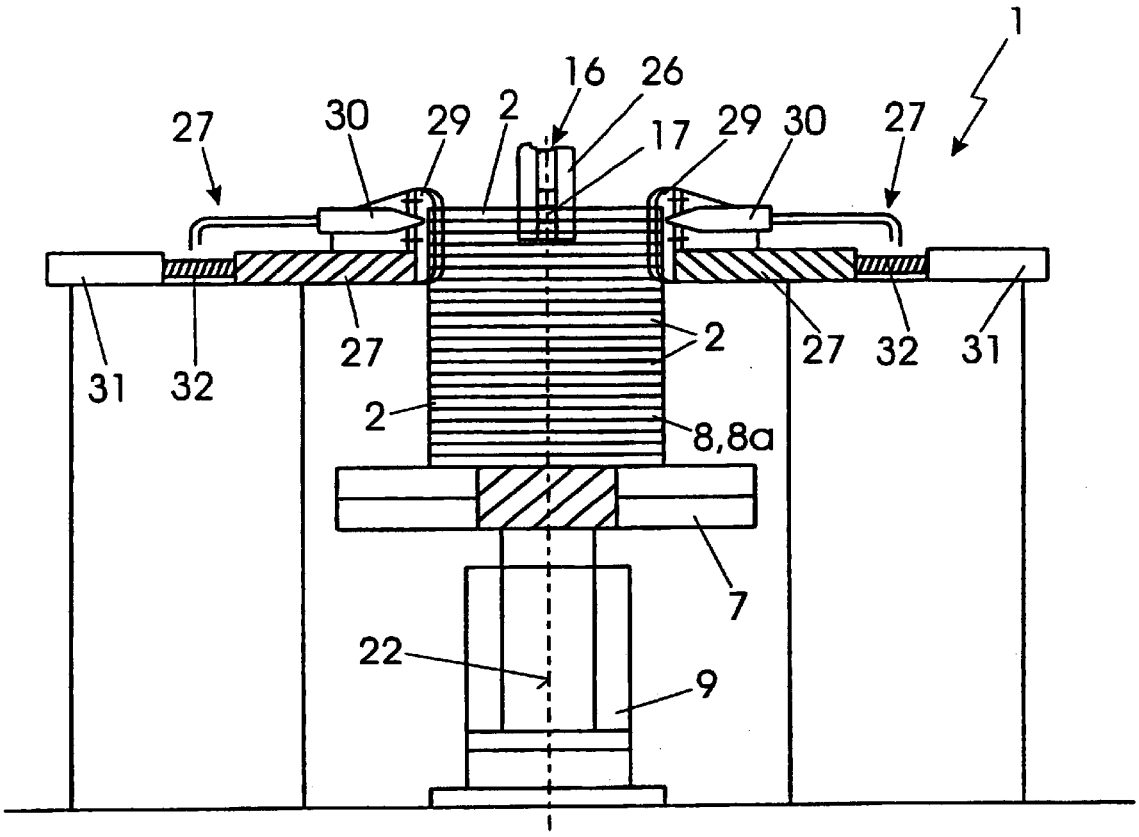
FIG. 4 is a sectional view along line IV—IV of FIG. 1.

The engagement of the wedge elements 17 in the metal sheet stack 8 can be initiated by a known type of limit switch on the supporting element 7 to report a certain path of the supporting element 7 in the downward direction and thus a certain height of the metal sheet stack 8. Subsequently, by moving the supporting element 7 downward, the metal sheet bundle 8*a* is guided past two connection devices which are constructed as welding devices 27 as illustrated in FIG. 4, and is welded together on its circumference by the welding devices 27. As described above, the punched metal sheets 2 are held by the clamping device 10 during this operation. The welding devices 27 are situated opposite one another and each consist of a welding platform 28, two centering strips 29, a welding nozzle 30 and a driving device 31 having a spindle 32. The welding devices 27 may be laser, electrode or plasma welding devices. The separating device 16 is illustrated to be rotated by 45° from the position in FIG. 1 to the position in FIG. 4 to be visible. The driving device 32 can also be constructed as a linear drive instead of the spindle 32.

The punched metal sheets 2 are connected with one another by welding devices 27, for example, for being able to use the resulting fixedly mutually connected metal sheet bundles 8*a* for producing rotors or stators of electric motors. In order to be able to weld together the entire metal sheet bundle 8*a*, the supporting element 7 has two mutually opposite recesses 33 which permit the free passage of the metal sheet bundle 8*a* past the welding devices 27.

If, in this case, the supporting element 7 has a rotatable construction or is connected with a corresponding rotating device, grooves can be provided on the circumference of the punched metal sheets 2 to be very easily be rotated with respect to one another. As a result, metal sheet bundles 8*a* used particularly in the case of asynchronous motors can be produced with oblique grooves and a diagonally situated weld seam. The punched metal sheets 2 can come to rest on the supporting element 7 in a mutually correspondingly rotated manner, which, however, can be carried out in a manner known per se. Naturally, it is also possible to provide the metal sheet bundles 8*a* with diagonal grooves and nevertheless weld them together in a straight manner.

Figure 5:
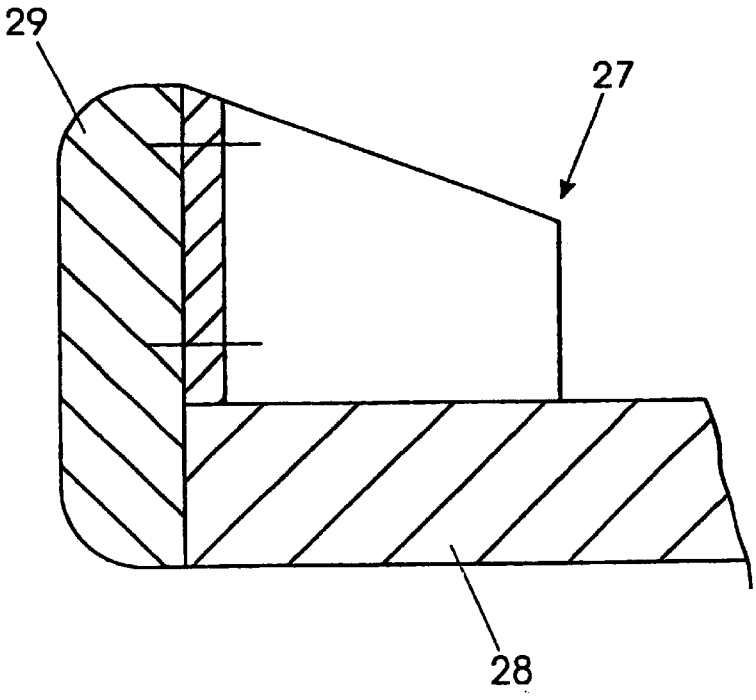
FIG. 5 is a sectional view along line V—V of FIG. 1.

FIG. 5 is an enlarged representation of a portion of the welding device 27. In this case, the welding platform 28 and the centering strips 29 are more easily visible.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for punching and bundling metal sheets, comprising a die for punching the metal sheets, a die plate cooperating with the die, a receiving shaft for receiving and stacking the metal sheets that have been punched, and a separating device for separating the metal sheets stacked in the receiving shaft, wherein the separating device includes at least two wedge elements configured to penetrate into a predetermined height of a metal sheet stack of the punched and stacked metal sheets at least approximately perpendicularly to a longitudinal axis of the receiving shaft wherein in an area of or below the receiving shaft a connection device is arranged to connect separated individual metal sheet bundles, and wherein the connection device comprises a welding device.

2. The system according to claim 1, wherein the welding device is a laser welder.

* * * * *